US008534176B2

(12) United States Patent
Giszter et al.

(10) Patent No.: US 8,534,176 B2
(45) Date of Patent: Sep. 17, 2013

(54) METHOD AND APPARATUS FOR BRAIDING MICRO STRANDS

(75) Inventors: Simon Giszter, Havertown, PA (US); Tae Gyo Kim, Philadelphia, PA (US); Arun Ramakrishnan, Philadelphia, PA (US)

(73) Assignees: Philadelphia Health & Education Corporation, Philadelphia, PA (US); Drexel University, Philadelphia, PA (US)

( * ) Notice: Subject to any disclaimer, the term of this patent is extended or adjusted under 35 U.S.C. 154(b) by 127 days.

(21) Appl. No.: 13/129,925

(22) PCT Filed: Nov. 19, 2009

(86) PCT No.: PCT/US2009/065156

§ 371 (c)(1),
(2), (4) Date: Aug. 4, 2011

(87) PCT Pub. No.: WO2010/059832

PCT Pub. Date: May 27, 2010

(65) Prior Publication Data

US 2011/0277618 A1 Nov. 17, 2011

Related U.S. Application Data

(60) Provisional application No. 61/199,699, filed on Nov. 19, 2008.

(51) Int. Cl.
*D04C 3/14* (2006.01)

(52) U.S. Cl.
USPC ..... 87/55

(58) Field of Classification Search
USPC ..... 87/16, 17, 37, 43, 50, 55, 62
See application file for complete search history.

(56) References Cited

U.S. PATENT DOCUMENTS

| | | | | | |
|---|---|---|---|---|---|
| 647,466 | A | * | 4/1900 | Bottenberg | 87/14 |
| 682,887 | A | * | 9/1901 | Schurmann | 87/43 |
| 920,994 | A | * | 5/1909 | Prante | 87/30 |
| 965,437 | A | * | 7/1910 | Brown et al. | 139/16 |
| 4,312,261 | A | * | 1/1982 | Florentine | 87/33 |

(Continued)

FOREIGN PATENT DOCUMENTS

| | | |
|---|---|---|
| KR | 92-0009425 | 10/1992 |
| KR | 10-0333517 | 4/2002 |
| WO | WO 01-17451 | 3/2001 |

OTHER PUBLICATIONS

Ko, F.K., "Nanofiber Technology: Bridging the Gap between Nano and Macro World," Nanoengineered Nanobrous Materials, 2004, 1-18.

(Continued)

*Primary Examiner* — Shaun R Hurley
(74) *Attorney, Agent, or Firm* — Woodcock Washburn, LLP

(57) ABSTRACT

A method and apparatus for fabricating microbraided structures is provided. A microbraiding device includes first and second carrier members that are movable with respect to each other. Each carrier includes a plurality of shelters. Spool-less strands of microfiber are retained in shuttles that are movable between the first and second shelters under magnetic forces. The microbraid structure is fabricated as the shuttles move between the first shelters, and as the first carrier member moves relative to the second carrier member.

24 Claims, 10 Drawing Sheets

(56) References Cited

U.S. PATENT DOCUMENTS

| | | | | |
|---|---|---|---|---|
| 4,506,673 | A | 3/1985 | Bonnell | |
| 4,972,756 | A | 11/1990 | Du et al. | |
| 5,287,790 | A | 2/1994 | Akiyama et al. | |
| 5,411,527 | A | 5/1995 | Alt | |
| 5,518,836 | A | 5/1996 | McCullough | |
| 5,520,084 | A | 5/1996 | Chesterfield et al. | |
| 6,315,778 | B1 | 11/2001 | Gambale et al. | |
| 6,487,326 | B1 | 11/2002 | Pantano et al. | |
| 6,907,810 | B2 * | 6/2005 | Kim | 87/16 |
| 7,405,854 | B2 | 7/2008 | Desai et al. | |
| 2002/0113335 | A1 | 8/2002 | Lobovsky et al. | |
| 2003/0137083 | A1 | 7/2003 | Ko et al. | |
| 2003/0168756 | A1 | 9/2003 | Balkus, Jr. et al. | |
| 2005/0010095 | A1 | 1/2005 | Stewart et al. | |
| 2005/0043894 | A1 | 2/2005 | Fernandez | |
| 2008/0136267 | A1 | 6/2008 | Laabs et al. | |
| 2009/0099441 | A1 | 4/2009 | Giszter | |

OTHER PUBLICATIONS

Pancrazio, J.J. et al., "Toward Neurotechnology Innovation: Report from the 2005 Neural Interfaces Workshop. An NIH-Sponsored Event," Neuromodulation, 2006, 9(1), International Neuromodulation Society, 1-7.

Angelopoulos, M., "Conducting polymers in microelectronics," IBM J. Res. & Dev., Jan. 2001, 45(1), 57-75.

Bohwon Kim et al., "Electrical Properties of Conductive Polymers: PET—Nanocomposites' Fibres," AUTEX Research Journal, Mar. 2004, 4(1), 9-13.

Giszter, S.F. et al., "Convergent force fields organizxed in the frog's spinal cord," J. Neurosci., Feb. 1993, 13(2), 467-491.

Giszter, S.F. et al., "Intraspinal microstimulation: techniques, perspectives and prospects for FES," (2000), Ch. 4, pp. 101-138 in Neural Prostheses for Restoration of Sensory and Motor Function, Ed. J.K. Chapin et al., CRC Press, Boca Raton.

Ko, F.K. et al., "Electrospinning of Continuous carbon Nanotube-Filled Nanofiber Yarns," Adv. Mater., Jul. 17, 2003, 15(14), 1161-1165.

Ko, F.K. et al., Atkins and Pearce Handbook of Industrial Braids, 1989, Entire Book.

Li, W.-J. et al., "Electrospun Nanofibrous Structure: A Novel Scaffold for Bioengineering," J. Biomedicals Materials Research, Wiley Interscience, Mar. 25, 2002, pp. 613-621.

Norris, I.D. et al., "Electrostatic Fabrication of Ultrafine Conducting Fibers: Polyaniline/polyethylene oxide blends," Synthetic Metals, 2000, 114, 109-114.

Rathnasingham, R. et al., "Characterization of implantable microfabricated fluid delivery devices," IEEE Trans. Biomed. Eng., Jan. 2004, 51(1), 138-145.

Rousche, P.J. et al., "A method for pneumatically inserting an array of penetrating electrodes into cortical tissue," Annals of Biomedical Engineering, 1992, 20(4), 413-422.

* cited by examiner

METHOD AND APPARATUS FOR BRAIDING MICRO STRANDS

CROSS-REFERENCE TO RELATED APPLICATIONS

This application is the National Stage of International Application No. PCT/US2009/065156, filed Nov. 19, 2009, which claims the benefit of U.S. Provisional Application No. 61/199,699, filed Nov. 19, 2008. This application is related to U.S. patent application Ser. No. 12/065,697, filed on Oct. 9, 2008, which claims the benefit of PCT Patent Application Serial No. PCT/US2006/035028, filed Sep. 8, 2006, which claims the benefit of U.S. Patent Application Ser. No. 60/715,228, filed on Sep. 8, 2005, the disclosure of each of which is hereby incorporated by reference as if set forth in its entirety herein.

GOVERNMENT RIGHTS

This invention was made with U.S. government support under Contract Nos. NS054894 and NS044564 awarded by the National Institutes of Health (NIH). The U.S. government has certain rights in the invention.

BACKGROUND

Braids, also known as plaits, are complex structures or patterns formed by intertwining or interweaving a plurality of strands of flexible material. Conventional devices exist that are capable of braiding large strands for clothing, rope, decorative objects, hairstyles, and the like. These large strands are possess strength sufficient to absorb applied stresses during operation, for instance as the strands are unspooled during the braiding operation. Such stresses, however, would cause finer strands to fail.

What is therefore needed is a method and apparatus for braiding finer strands, such as strands of microfibers.

SUMMARY

A braiding device is provided that is suitable for making microbraids. The braiding device includes a first carrier including at least a first shelter, and a second carrier disposed proximate to the first carrier such that at least one of the carriers is movable with respect to the other carrier. The second carrier includes at least a second shelter. The braiding device includes at least one shuttle configured to retain one of a plurality of strands. A mover is configured to move the shuttle between the first and second shelters. The mover includes a first biasing member configured to impart a first retention force onto the shuttle that biases the shuttle against the mover, and one of the first and second carriers includes a second biasing member configured to impart a second retention force that biases the shuttle into the corresponding shelter.

DETAILED DESCRIPTION OF ILLUSTRATIVE EMBODIMENTS

Figure 1A:
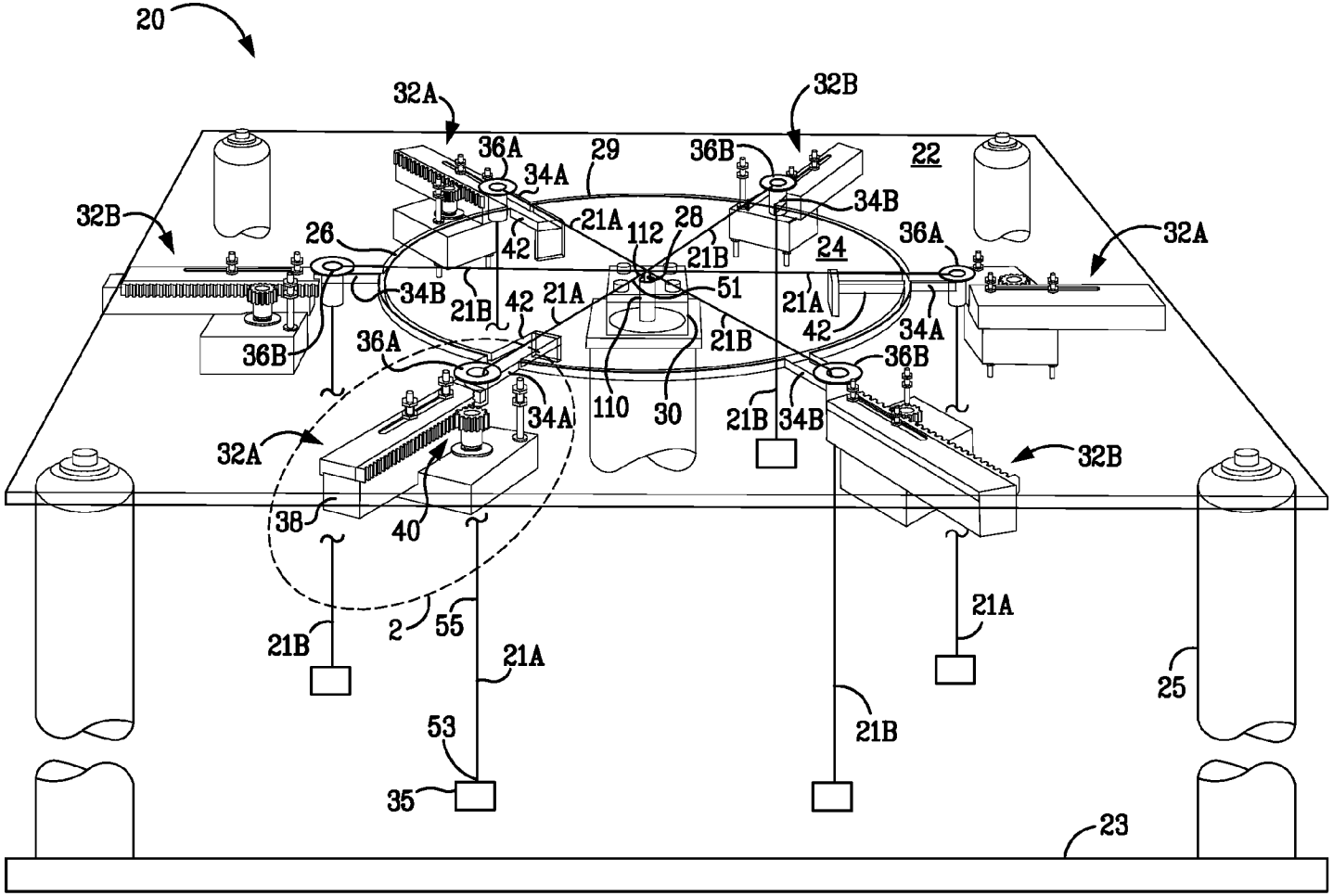
FIG. 1A is a perspective view of a braiding device including a plurality of braiding stations constructed in accordance with one embodiment.

Referring to FIG. 1A, a braiding device 20 is provided for producing microbraids, or braided strands 21 of micro fibers of the type described in U.S. patent application Ser. No. 12/065,697, filed on Oct. 9, 2008, the disclosure of which is incorporated by reference as if set forth in its entirety herein. For instance, the micro strands can be formed from any suitable flexible material such as textile, fiber, wire, spider or other silk strands, and the like on the order of scale of a human hair or finer. The strands can be electrically conductive.

For example, the braided strands may be provided as conductors that comprise metals, such as nichrome or stainless steel. Nichrome wires can be provided having an average diameter of 13 um. The conductors may also comprise conductive polymers such as lithium doped polyaniline and polyethylene dioxythiophene. In some embodiments, the conductors may comprise conductive proteins. In yet others, the conductors may be conductive nanotubes or nanofilaments, for example, carbon nanotubes or nanowires. These materials may be microscale, nanoscale, or combinations of both microscale and nanoscale materials. In some embodiments, the conductors may be hollow. In preferred embodiments, at least one conductor has a length that is at least 100 times greater than its diameter and, in some embodiments may be monofilaments.

The conductors can be insulated with a material such as with Teflon or Parylene C. The insulating material can be any polyimide or other electrical insulator. In embodiments of the present invention, the conductors may comprise intermittent insulation along the length of the conductors, providing a plurality of sites along the length of the braided structure for use in sensing or stimulation of the central or peripheral nervous system.

The braiding device 20 will now be described with initial reference to FIG. 1A. As illustrated, the device 20 includes a first, or outer, carrier member 22 and a second, or inner, carrier member 24 disposed adjacent or proximate to the outer carrier member 22. The carrier members 22 and 24 can be made from transparent glass or any suitable alternative material. In the illustrated embodiment, the outer carrier member 22 can be provided as a plate that defines a circumferentially inner end 31 that, in turn, defines a central cylindrical opening 26. The inner carrier member 24 can be provided as a cylindrical plate that defines an outer cylindrical end 29 sized to fit within the opening 26. The braiding device 20 can include a plurality of legs 25 that extend downward from the outer and inner carrier members 22 and 24 include and rest on a support surface 23, which can be a floor or tabletop, or the like.

A radial gap 27 (for instance a quarter inch gap illustrated in FIG. 2) can be disposed between the outer circumferential end 29 of the inner carrier member 24 and the radially inner end 31 of the outer carrier member 22. The gap can allow the inner and outer carrier members to easily move relative to each other. As illustrated, the outer carrier member 22 is square plate dimensioned 24 inches by 24 inches or as otherwise desired, and the inner carrier member 24 can define a diameter of 10 inches or as otherwise desired.

The inner carrier member 24 defines a central hub 28 that is attached at its lower end to a motor 30 configured to rotate the inner carrier member 24 inside and relative to the outer carrier member 22. The outer carrier member 22 can remain stationary as the inner carrier member 104 rotates in accordance with the illustrated embodiment. Alternatively, the outer carrier member 22 could rotate about the stationary inner carrier member 24. Alternatively still, both carrier members 22 and 24 could rotate such that carriers rotate relative to one another.

The braiding device 20 further includes a plurality of shelters that allow for movement of the strands between locations at the outer carrier member 22 and locations at the inner carrier member 24. The outer carrier member 22 supports a plurality of outer shelters 34 that are equidistantly spaced circumferentially about the opening 26. As illustrated, six outer shelters 34 are equidistantly spaced on the outer carrier member 22 and circumferentially about the opening 106 such that 60° separates each shelter 34.

As will be described in more detail below, the shelters 34 are divided into two groups of shelters 34A and 34B arranged in an alternating relationship such each shelter 34A is disposed circumferentially between shelters 34B, and each shelter 34B is disposed circumferentially between shelters 34A. Hence, each of the first group of shelters 34A may be located at positions defined by angles 0°, 120°, and 240°, while each of the second group of shelters 34B may be located at positions defined by angles 60° 180°, and 300°.

The inner carrier member 24 supports a plurality of inner shelters 42 that are equidistantly spaced circumferentially at the outer circumferential end 29 of the inner carrier member 24. In accordance with the illustrated embodiment, the braiding device 20 includes twice the number of outer shelters 34 than inner shelters 42. Thus, in the embodiment illustrated in FIG. 1A, three inner shelters 42 are equidistantly spaced circumferentially about the radially outer end of the inner carrier member 104, such that 120° separates each shelter 34. Thus, the inner shelters 42 can be disposed at 0°, 120°, and 240° about the outer end 29 of the inner carrier member 24. The inner carrier member 24 can thus be rotated to a position whereby the inner shelters 42 can be selectively radially aligned with the first group of shelters 34A and the second group of shelters 34B.

Figure 2:
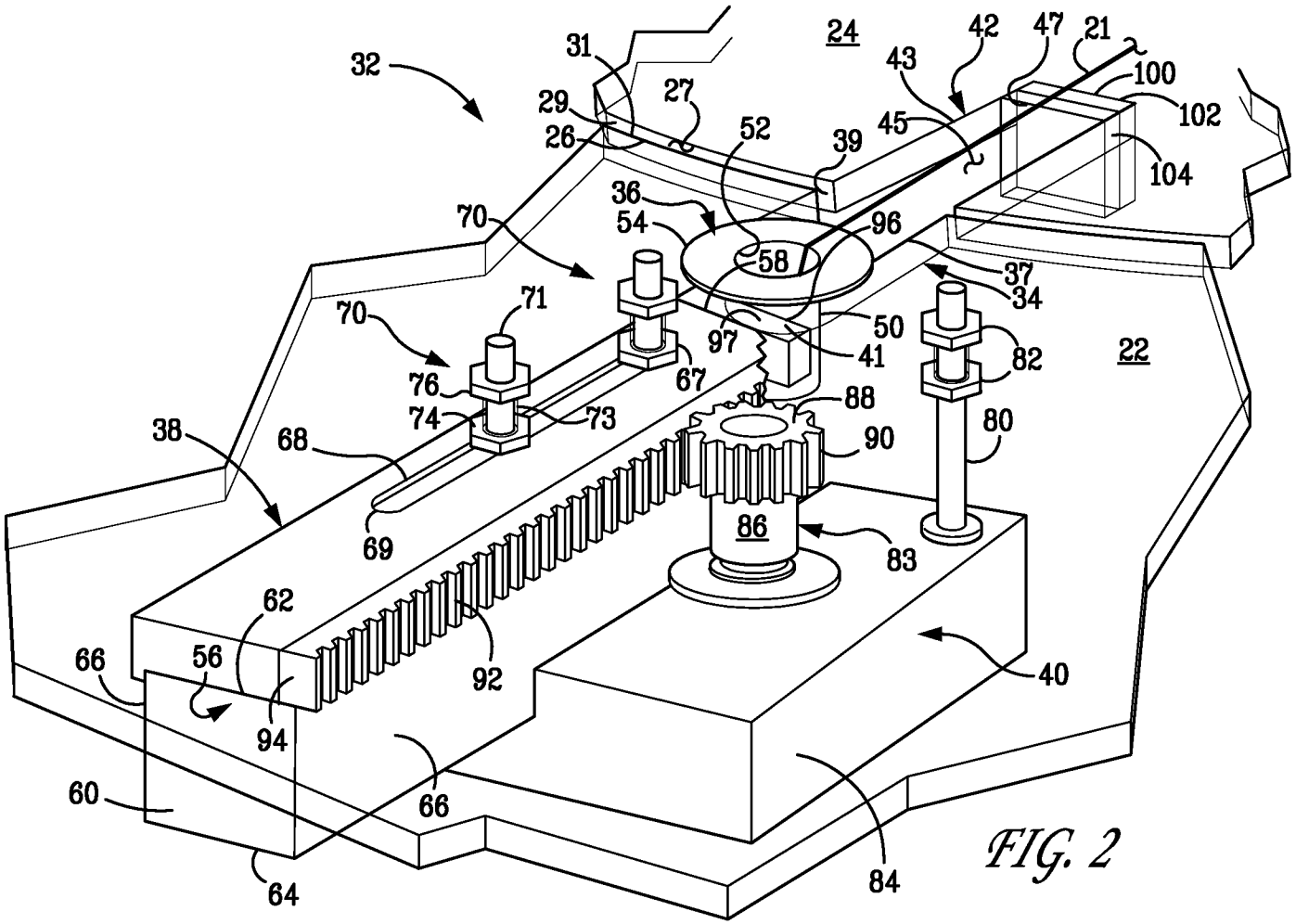
FIG. 2 is an enlarged perspective view of one of the braiding stations illustrated in FIG. 1A.

Referring now to FIG. 2, each outer shelter 34 constructed in accordance with the illustrated embodiment is provided as a groove 37 extending vertically through the outer carrier member 22, and extending radially outward from the inner end 31 into the carrier member 22. Thus, the groove 37 defines a proximal end 39 disposed at the inner end 31, and terminates at a distal end 41 that is disposed radially outward with respect to the proximal end 39.

Each inner shelter 42 is provided as a groove 43 extending vertically through the inner carrier member 24, and extending radially outward from the radially outer end 29 into the inner carrier member 24. Thus, the groove 43 defines a proximal end 45 that is disposed at the outer end 29, and terminates at a distal end 47 that is disposed radially inward with respect tot the proximal end 45. Thus, the proximal end 39 of each outer shelter 34 is configured to face the proximal end 45 of each inner shelter 42. While the shelters 34 and 42 are illustrated as grooves extending into the associated carrier member, it should be appreciated that any alternative structure suitable for retaining strands to be braided during operation of the device 20 are contemplated.

The shelters 34 and 42 permit one of the carrier members to define an outer location of a first group of strands 21, and the other carrier member to define an inner location of a second group of strands 21. Accordingly, the first and second groups of strands can be braided as the inner carrier member 24 rotates relative to the outer carrier member 22.

It should be appreciated in accordance with an alternative embodiment that the six shelters could be provided on the inner carrier member, and three shelters could be provided on the outer carrier member. Accordingly, one carrier member can include a number of shelters equal to the number of strands to be braided, while the other carrier member can include a number of shelters equal to one-half the number of strands to be braided.

The braiding device 20 further includes a plurality of transfer stations 32 that allow for movement of the strands 21 between the outer shelters 34 and radially aligned inner shelters 42. Each transfer station 32 includes a shuttle 36 configured to retain one of the strands 21, a mover 38 configured to move the shuttle 36 between radially aligned shelters 34 and 42, and a force transfer member 40 configured to provide a biasing force to the mover 38 that cause the mover 38 to translate forward and backward, thereby moving the shuttle 36 between the radially aligned shelters 36 and 42.

In the illustrated embodiment, the outer carrier member 22 includes a transfer station 32 operatively coupled to each outer shelter 34. Thus, six transfer stations 32 are circumferentially disposed about the outer carrier member. The transfer stations 32 can be substantially identically constructed, such that a description of one transfer station 32 applies to all other transfer stations unless otherwise indicated. Each of the transfer stations 32 will now be described with respect to one of the transfer stations 32 illustrated in FIG. 2.

In particular, each shuttle 36 can be provided as a metallic grommet including a body 50 that defines an opening 52 extending vertically through the body 50, and a flange 54 extending radially out from the upper end of the body 50. The opening 52 can be cylindrical, and can have a diameter between about 0.5 inch and about 2 inches, for instance approximately 1 inch. It should be appreciated that the geometry of the shuttle 36 can be configured to minimize fiber stress. The flange 54 is sized greater than the circumferential thickness of the grooves that define the shelters 34 and 42, and is configured to rest on the upper surface of the carrier members 22 and 24 under gravitational forces. If desired, a second flange can extend radially out from the bottom end of the body 50 such that the pair of vertically spaced flanges captures the carrier members 24 and 24 therebetween. The body 50 can be cylindrical, and has a thickness or diameter that is less than the circumferential thickness of the grooves that define the shelters 34 and 42. Accordingly, when the shuttle 36 is disposed at one of the shelters 34 or 42, the body 50 extends vertically below the flange 54 and through the groove that corresponds to the shelter. The shuttle 36 can then translate along and between radially aligned shelters 34 and 42, thereby moving the retained strand 21 between the outer carrier member 22 and the inner carrier member 24.

Each transfer assembly 32 further includes a mover 38 mounted onto a rectangular support housing 56. The support housing 56 defines opposing radially inner and outer end walls 58 and 60, and opposing upper and lower walls 62 and 64, respectively, and opposing side walls 66 extending between the inner and outer end walls 58 and 60. Both the mover 38 and the housing 56 are radially elongate, and the mover is slidably mounted onto the upper wall 62 of the housing 56. The mover 38 defines a groove 68 that extends vertically through the upper surface of the mover 38. The groove 68 is radially elongate in a direction parallel to the corresponding outer shelter 34. The groove 68 extends between a radially inner end 67 and a radially outer end 69.

The upper wall 52 further carries a pair of guide members 70 that are radially aligned in a direction parallel with respect to the corresponding shelter 34. In the illustrated embodiment, the guide members 70 are aligned with the corresponding shelter 34. Each guide member 70 includes central rod 71 extending through an aperture 73 that extends vertically through the outer carrier member 22. Thus, the position of the rod 71 is fixed with respect to the outer carrier member 22. A lower nut 74 and an upper nut 76 are carried by the rod 71, such that the outer carrier member 22 is captured between the nuts 74 and 76.

The rod 71 further extends into the groove 68, and has a diameter substantially equal to the thickness of the groove 68 such that the pair of guide members 70 permits the mover to slide radially as the groove 68 passes along the rods 71. Thus, the mover 38 is slidable with respect the support housing 56 and the outer carrier member 22. In particular, the mover 38 is slidable between a first retracted, or radially inward, position whereby a magnet 97 carried by the mover 38 is aligned with the outer shelter 34, and a second extended, or radially outward, position whereby the magnet is aligned with the inner shelter 42.

The transfer station 32 further includes a force transfer member 40 supported by the outer carrier member 22 via a support rod 80 that carries upper and lower nuts 82 that capture the outer carrier member 22 therebetween. The force transfer member 40 includes a drive mechanism 83 illustrated as including a force transfer motor housing 84 that retains a stepping motor, and a rotating drive shaft 86 extending vertically up from the housing 84.

The drive shaft 86 carries a drive mechanism 88 in the form of a pinion that presents teeth 90 that intermesh with complementary teeth 92 of a rack 94 that extends radially along the side wall of the mover 28. The drive shaft 86 and pinion 88 is rotatable about a vertical axis, for instance in a first direction (clockwise as illustrated) that causes the mover 38 to translate in a radially inward direction toward the aligned inner shelter 42, while rotation of the pinion 88 in an opposing second direction (counterclockwise as illustrated) causes the mover 38 to translate in a radially outward direction away from the aligned inner shelter 42. The maximum stroke length of the mover 38 can be configured as desired based, for instance, on the radial lengths of the shelters 34 and 42.

While the force transfer member 40 has been illustrated and described in accordance with one embodiment, it should be appreciated that the force transfer member could be constructed in accordance with numerous alternative configurations that allow the mover 66 to translate with respect to the outer carrier member 22. For instance, mover 38 could include a rotatable pinion that intermeshes with a rack supported by the outer carrier member 22.

With continuing reference to FIG. 2, the radially inner end wall 58 of the mover 38 carries a biasing member 96 can be provided as a magnet 97, such as a permanent magnet, that is configured to apply a retention force onto the shuttle 36. The magnet 97 can be attached to the radially inner surface of the end wall 58 external to the mover 38, or can be attached to the radially outer surface of the end wall 58 insider the mover 38, which can be made from a plastic that allows the magnetic field from the magnet 97 to pass through. The magnet 97 can be positioned in vertical alignment with the body 50 of the shuttle 36, such that the magnet 97 can provide a biasing retention force that force that biases the body 50 in a radially outward direction against the radially inner end wall 58 of the mover 38.

The inner carrier member 24 also includes a biasing member 100 associated with each of the inner shelters 42. The biasing member 100 can be provided as a magnet 102, such as a permanent magnet, extending down from the undersurface of the inner carrier member 24 at a location in alignment with the corresponding shelter 42 at a location radially inward of the radially inner end 47 of the shelter 42. The magnet 102 is vertically aligned with the body 50 of the shuttle 36, and is thus configured to apply a retention force onto the body 50 that biases the body radially inward direction.

A vertical dampening wall 104 can extend down from the inner carrier member 24 at a location between the magnet 102 and the corresponding shelter 42. The wall 104 can be made of a nonmagnetic material, and can dampen the magnetic force of the magnet 102 that passes through the wall 104. In this regard, the vertical wall 104 provides a dampener that reduces the magnetic force provided by the magnet 102, such that the corresponding retention force that acts on the shuttle 36 from the magnet 102 is less than the retention force that acts on the shuttle 36 from the magnet 97, even when the magnets 97 and 102 are similarly constructed with the same magnetic force. Alternatively, the inner carrier member 24 can be devoid of dampeners, and the magnet 102 can be constructed to provide a reduced magnetic force with respect to the magnet 97.

As will be more appreciated from the description below, when the shelter 34 is aligned with an inner shelter 42, the transfer station 32 can iterate or "push" the shuttle 36, and thus the retained strand 21, from a first radially outward position in the outer shelter 34 to a second radially inward position in the inner shelter 42. Furthermore, because the magnet 97 of the transfer station 32 applies a biasing force onto the shuttle 36 that is greater than the biasing force applied from the magnet 102 of the inner shelter 42 onto the shuttle 36, the transfer station 32 can likewise iterate, or "pull" the shuttle 36 radially outward from the inner shelter 42 into the outer shelter 34.

Figure 1B:
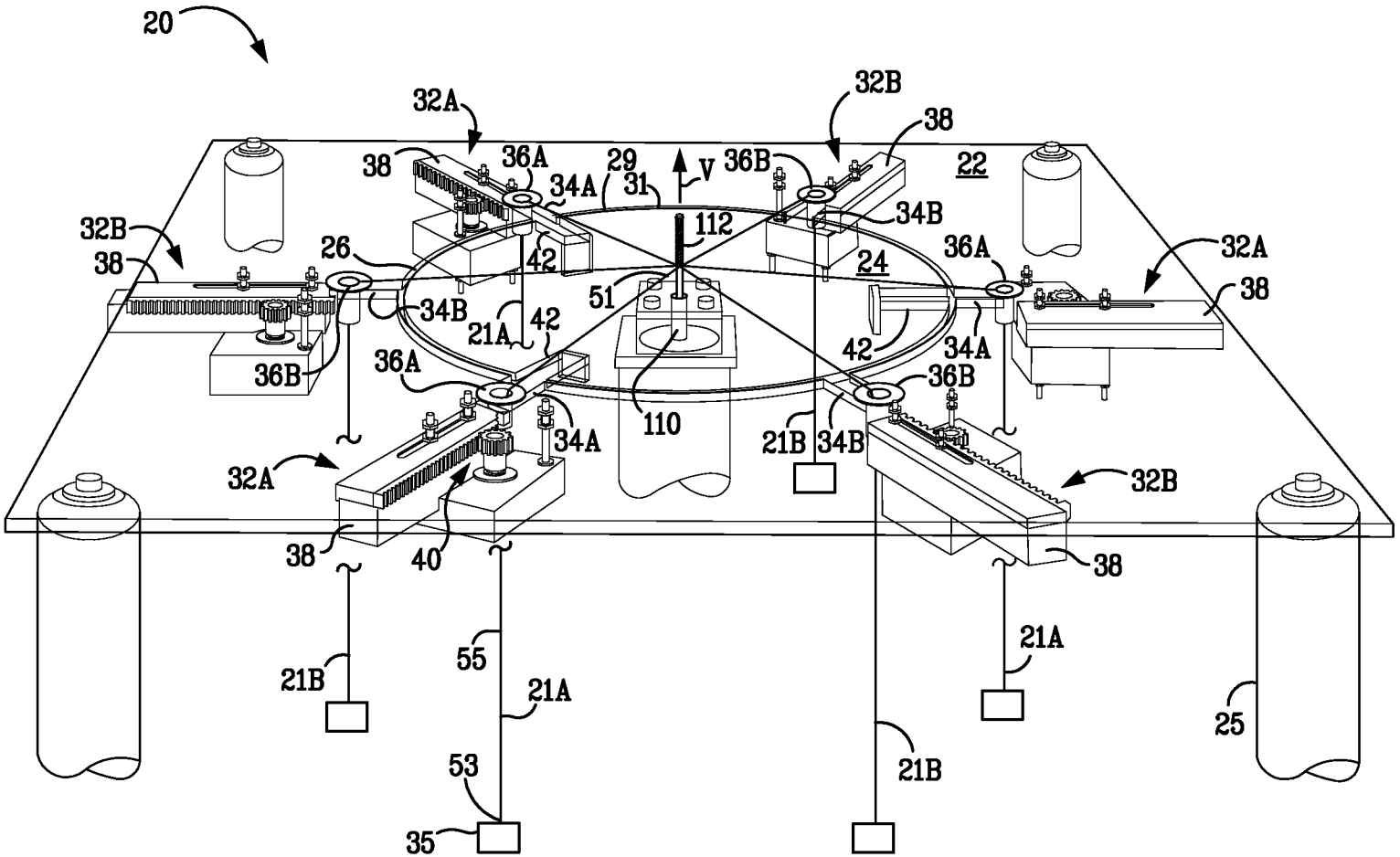
FIG. 1B is a perspective view of the braiding device illustrated in FIG. 1A, during operation.
Figure 4:
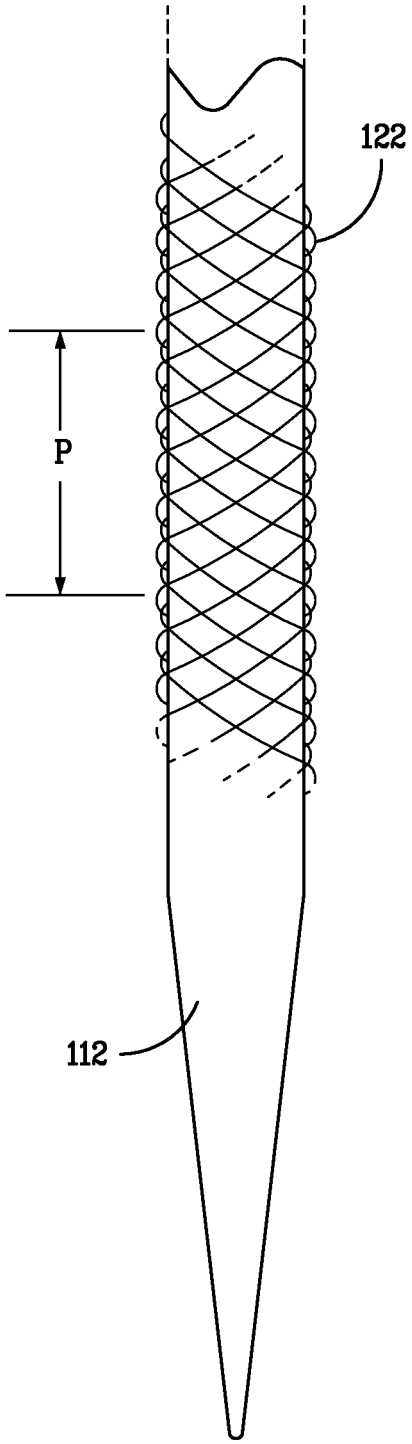
FIG. 4 is a side elevation view of a braided structure, braided about a form.

Referring now to FIGS. 1A-B and FIG. 4, the strands 21 to be braided can be supported at a location above the inner carrier member 24 at the center of the carrier member 24, at a position in radial alignment with each shelter 34 and 42. For instance, a central shaft that can provide a core holder 110 extends up from the motor 30, and is attached to a substantially cylindrical braiding core 112 about which the strands 21 can be braided. The strands 21 each define a proximal end 51 attached to the braiding core 112, a terminal distal end 53, and a middle portion 55 disposed between the proximal and distal ends. The middle portion 55 of each strand 21 extends through a corresponding shuttle 36, and the distal end 53 of each strand 21 can be fastened to a small weight 35, such as tape, clay, or the like, that induces tension in the strands 21 that is sufficient to prevent slack from occurring in the strands 21, but insufficient to break the strands 21. Accordingly, the legs 25 are of a sufficient height such that the distal end 53 of each strand 21 is suspended above the support surface 23. It should thus be appreciated that one or more, up to all, of the strands 21 can be spool-less. Otherwise stated, the braiding device 20 can be devoid of spools while at the same time ensuring sufficient tension in the strands 21 without causing the strands 21 to fail.

The braiding device 20 can be referred to as a micro braiding device suitable for braiding strands 21 of microfibers that have a diameter or thickness between about 0.3 mm and about 600 nm. For instance, the strands 21 can have average diameters on the order of from about 0.1 mm to about 50 um. In other applications, average strand diameters can range from about 0.1 mm to about 1 um, such as about 13 um. It should be appreciated, of course, that while the braiding device 20 is capable of braiding strands of microfibers as described above, a braiding device of the type describer herein is further capable of braiding strands of any desired composition and diameter.

The strands 21 spaced circumferentially equidistantly about the device 20, and each strand 21 extends through a corresponding shuttle 36. The strands 21 are divided into two groups of strands 21A and 21B arranged in an alternating relationship such that each strand 21A is disposed circumferentially between strands 21B, and each strand 21B is disposed circumferentially between strands 21A. Hence, each of the first group of strands 21A may be located at positions defined by angles 0°, 120°, and 240°, while each of the second group of strands 21B may be located at positions defined by angles 60°, 180°, and 300°. Likewise, the shuttles 36 are divided into two first and second respective groups of shuttles 36A and 36B that retain the first and second groups of strands 21A and 21B, respectively.

Figure 3C:
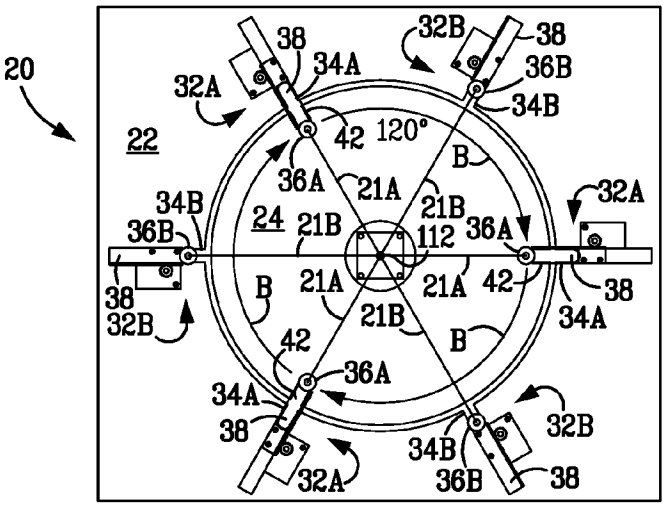
FIG. 3C is a schematic top plan view of the braiding device similar to FIG. 3B, but showing the braiding device at a second stage of operation.

A method for operating the braiding device to fabricate a microbraid structure will now be described with initial reference to FIGS. 1 and 3A-M. Throughout the description of the method of operation below, a description of the position of the shuttles 36A and 36B likewise pertains to position of the strands 21A and 21B retained therein. In particular, as illustrated in FIGS. 1A and 3A, when the device 20 is in an initial position, the first group of shuttles 36A and the second group of shuttles 36B are disposed in a first radially outward position in the first group of outer shelters 34A and the second group of outer shelters 34B, respectively, of the outer carrier member 22. Each strand 21 is then attached at its proximal end to the upper end of the braiding core 112, and fed through the opening of its associated shuttle 36, and provided with a weight 35 in the manner described above. The shelters 42 are then radially aligned with the first group of shelters 34A, while the second group of shelters 34B is not radially aligned with any inner shelters 42.

Figure 3B:
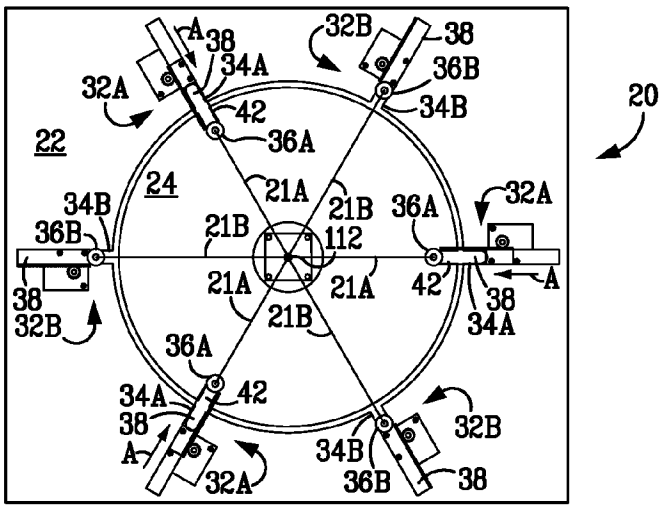
FIG. 3B is a schematic top plan view of the braiding device similar to FIG. 3A, but showing the braiding device at a first stage of operation.
Figure 3A:
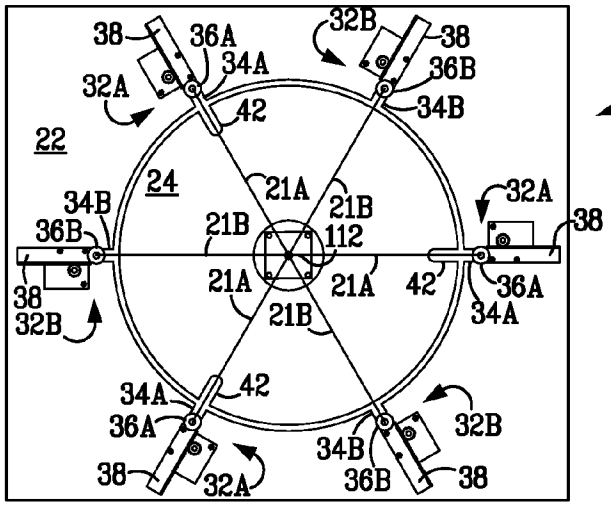
FIG. 3A is a schematic top plan view of the braiding device illustrated in FIG. 1A at an initial stage of operation.

Referring to FIGS. 1 and 3B, the method iterates the braiding device 20 to a first position, whereby the pinions 88 associated with the first group of transfer assemblies 32A are driven in a predetermined direction (clockwise as illustrated) that causes the corresponding mover 38 to translate radially inwardly. Each mover 38 thus correspondingly translates or "pushes" the associated shuttle 36A radially inwardly along the direction of Arrow A from the shelter 34A, across the gap 27 that separates the carrier members 22 and 24, and along the aligned inner shelter 42 until each mover 38 reaches a second position, whereby the associated shuttle 36A (and strand 21A extending through the shuttle 36A) is delivered to the radially inner end of the shelter 42. The gap 27 has a thickness less than the diameter of the body 50 of the shuttle 36A such that each shuttle 36A remains in its proper position as it crosses between shelters 34A and 42. Thus, both the mover 38 and the retention forces of the magnets 102 stabilize the shuttles 36A in the radially inner ends of the shelters 42. As the first group of shuttles 36A is delivered to the aligned shelters 42, each of the first group of strands 21A "crosses over" the second group of strands 21B.

Next, referring to FIGS. 1 and 3C, the method iterates the braiding device to a second position, whereby the inner carrier member 24 is rotated relative to the outer carrier member 22 in a first direction along the direction of Arrow B, which is clockwise as illustrated in FIG. 3C. It should be appreciate that the first direction could alternatively be counterclockwise if desired. The carrier member 22 is rotated 120° such that the inner shelters 42 and retained shuttles 36A become radially aligned with the subsequent shelters of the first group 34A in clockwise sequence. As the inner carrier member rotates 120° clockwise, each of the first group of strands 21A is intertwined with each of the second group of strands 21B. The motor 30 that rotates the inner carrier member 24 and the motors 84 that drive the movers 38 can be controlled by a controller or PC software.

It should be appreciated that as the inner carrier member 24 rotates, the first group of shuttles 36A disposed in the shelters 42 moves tangentially with respect to the magnets 97 carried by the movers 38 of the first transfer station 32A. Because the radial retention force of the magnets 102 associated with the shelters 42 is greater than the tangential retention force provide by the magnets 97 of the transfer stations 32A, the shuttles 36A become disengaged from the movers 38 as the inner carrier member 24 rotates relative to the outer carrier member 22. Furthermore, the movers 38 can remain in place as the forces exerted by the rotating carrier member 24 overcome the magnetic attraction of the transfer assembly 32. Alternatively, if desired, the mover 38 of the first group of transfer stations 32A can retract radially outward if desired as the inner carrier member 24 rotates to avoid possible interference between the magnets 97 of the transfer assembly 32A and the rotating shuttles 36A.

Figure 3F:
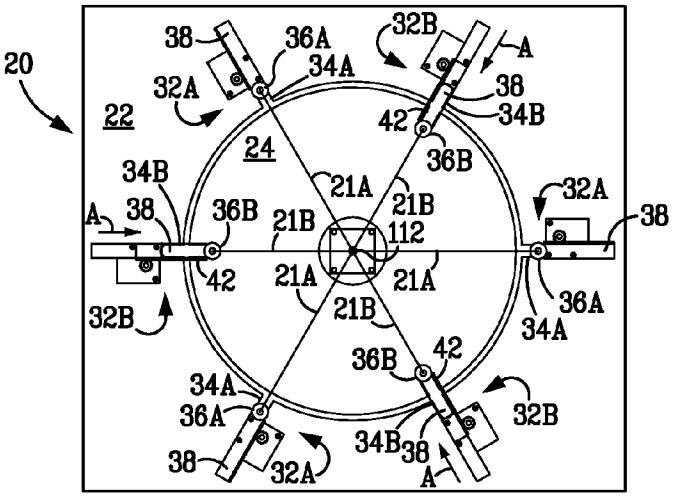
FIG. 3F is a schematic top plan view of the braiding device similar to FIG. 3E, but showing the braiding device at a fifth stage of operation.
Figure 3E:
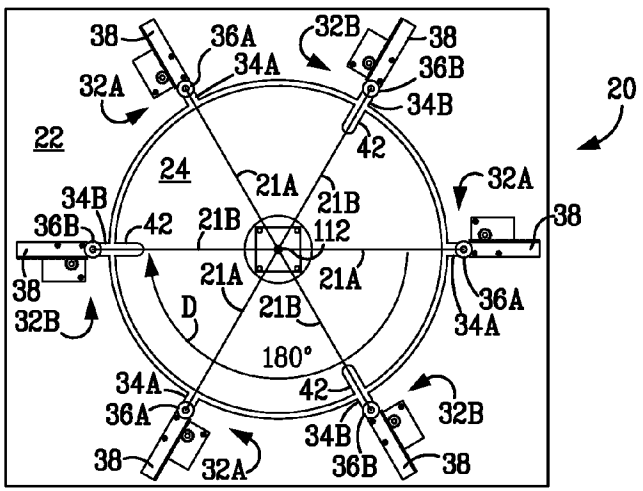
FIG. 3E is a schematic top plan view of the braiding device similar to FIG. 3D, but showing the braiding device at a fourth stage of operation.
Figure 3D:
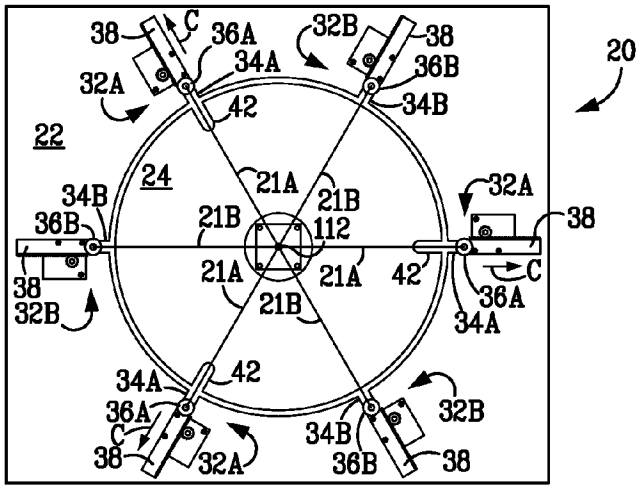
FIG. 3D is a schematic top plan view of the braiding device similar to FIG. 3C, but showing the braiding device at a third stage of operation.

Next, referring to FIG. 3D, once the inner carrier member 24 has completed the 120° rotation, the shuttles 36A are again aligned with the movers 38 of the first transfer stations 32A. If the movers 38 remained positioned at their radially innermost positions illustrated in FIG. 3B, then the shuttles 36A are brought into contact with the magnets 97 carried by the movers 38. Alternatively, if the movers 38 are retracted radially outward upon rotation of the inner carrier member 24, then the movers are extended radially inward after rotation of the inner carrier member 24 until the magnets 97 are brought into contact with the shuttles 36A. The movers 38 of the first group of transfer stations 32A are then retracted radially outward along the direction of Arrow C. Because the radial retention force of each magnet 97 is greater than the radial retention force of each magnet 102, retraction of the movers 38 of the first group of transfer stations 32 causes the associated shuttles 36A to become disengaged from the magnets 102 and move radially outward along with the movers 38. The movers 38 associated with the transfer stations 32A thus "pull" the shuttles 36A from the shelters 42 to the shelters 34A. It should be appreciated that the shuttles 36A are positioned in different shelters 34A of the second group of shelters 34A with respect to the initial shelter that the shuttles 36A were disposed in prior to being moved into the shelters 42.

Next, referring to FIG. 3E, once the shuttles 36A are disposed in the shelters 34A, such that the inner shelters 42 are devoid of shuttles, the inner carrier member 24 is then rotated 180° in a second direction (counterclockwise as illustrated) along the direction of Arrow D, which is opposite the direction of Arrow B. It should be appreciated that the second direction could alternatively be clockwise if so desired. After the inner carrier member 24 has completed the 180° rotation, each of the second group of shuttles 36B that carry the second group of strands 21B is radially aligned with inner shelters 42. The movers 38 associated with the transfer stations 32B are disposed in a first radially outward position such that the magnet 120 is aligned with the shelter 34B.

Next, referring to FIG. 3F, the pinions 88 associated with the second group of transfer assemblies 32A are driven in a predetermined direction (clockwise as illustrated) that causes the corresponding movers 38 to translate radially inwardly. Each mover 38 thus correspondingly translates or "pushes" the associated shuttle 36B radially inwardly along the direction of Arrow A from the shelter 34B, and along the aligned inner shelter 42 until each mover 38 reaches a second position, whereby the associated shuttle 36B (and strand 21B extending through the shuttle 36B) is delivered to the radially inner end of the shelter 42. Thus, both the mover 38 and the retention forces of the magnets 102 stabilize the shuttles 36B in the radially inner ends of the shelters 42. As the second group of shuttles 36B is delivered to the aligned shelters 42, the each of the second group of strands 2B "crosses over" the first group of strands 21A.

Figure 3I:
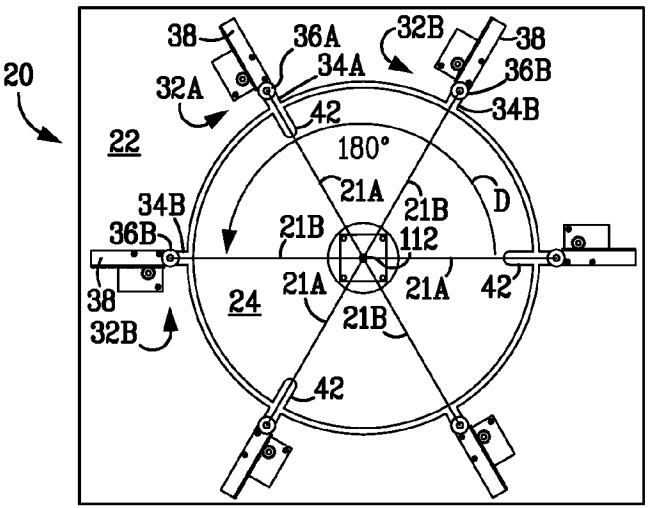
FIG. 3I is a schematic top plan view of the braiding device similar to FIG. 3H, but showing the braiding device at a eighth stage of operation.
Figure 3H:
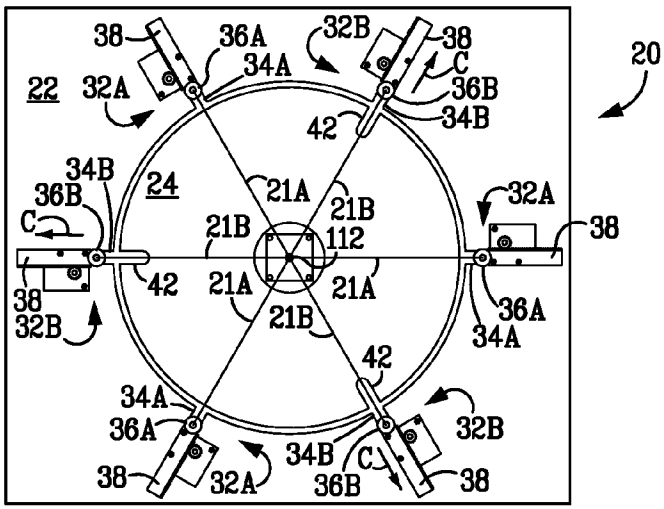
FIG. 3H is a schematic top plan view of the braiding device similar to FIG. 3G, but showing the braiding device at a seventh stage of operation.
Figure 3G:
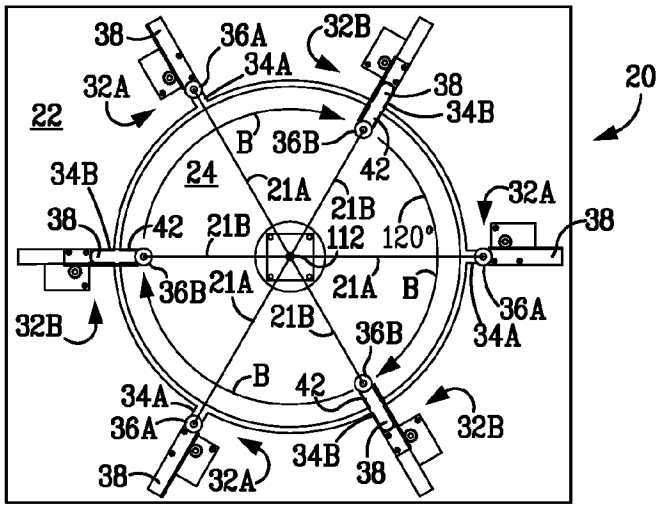
FIG. 3G is a schematic top plan view of the braiding device similar to FIG. 3F, but showing the braiding device at a sixth stage of operation.

Next, referring to FIG. 3G, the inner carrier member 24 is rotated relative to the outer carrier member 22 in a first direction along the direction of Arrow B, which is clockwise as illustrated in FIG. 3G. It should be appreciate that the first direction could alternatively be counterclockwise if desired. The carrier member 22 is rotated 120° such that the inner shelters 42 and retained shuttles 36B become radially aligned with the subsequent shelters of the first group 34B in clockwise sequence. As the inner carrier member 24 rotates 120° clockwise, each of the second group of strands 21B is intertwined with each of the first group of strands 2A.

It should be appreciated that as the inner carrier member 24 rotates, the second group of shuttles 36*b* disposed in the shelters 42 moves tangentially with respect to the magnets 97 carried by the movers 38 of the second transfer station 32B. Because the radial retention force of the magnets 102 associated with the shelters 42 is greater than the tangential retention force provide by the magnets 97 of the transfer stations 32B, the shuttles 36B become disengaged from the movers 38 as the inner carrier member 24 rotates relative to the outer carrier member 22. Furthermore, the movers 38 can remain in place as the forces exerted by the rotating carrier member 24 overcome the magnetic attraction of the transfer assembly 32B. Alternatively, if desired, the movers 38 of the second group of transfer stations 32B can retract radially outward if desired as the inner carrier member 24 rotates to avoid possible interference between the magnets 97 of the transfer assembly 32B and the rotating shuttles 36B.

Next, referring to FIG. 3H, once the inner carrier member 24 has completed the 120° rotation, the shuttles 36B are again aligned with the movers 38 of the second transfer stations 32B. If the movers 38 remained positioned at their radially innermost positions, then the shuttles 36B are brought into contact with the magnets 97 carried by the movers 38. Alternatively, if the movers 38 are retracted radially outward upon rotation of the inner carrier member 24, then the movers 38 are extended radially inward after rotation of the inner carrier member 24 until the magnets 97 are brought into contact with the shuttles 36B. The movers 38 of the second group of transfer stations 32B are then retracted radially outward along the direction of Arrow C. Because the radial retention force of each magnet 97 is greater than the radial retention force of each magnet 102, retraction of the movers 38 of the second group of transfer stations 32B causes the associated shuttles 36B to become disengaged from the magnets 102 and move radially outward along with the movers 38. The movers 38 associated with the transfer stations 32B thus "pull" the shuttles 36B from the shelters 42 to the shelters 34B. It should be appreciated that the shuttles 36B are positioned in different shelters 34B of the second group of shelters 34B with respect to the initial shelter that the shuttles 36B were disposed in prior to being moved into the shelters 42.

Finally, referring to FIG. 3I, once the shuttles 36B are disposed in the shelters 34B, such that the inner shelters 42 are devoid of shuttles, the inner carrier member 24 is then rotated 180° in the second direction (counterclockwise as illustrated) along the direction of Arrow D. After the inner carrier member 24 has completed the 180° rotation, each of the first group of shuttles 36A that carry the first group of strands 21A is radially aligned with inner shelters 42. Accordingly, the steps illustrated in FIGS. 3A-3D can be repeated to cross the first group of strands 21A over the second group of strands 21B, step 3E can be repeated to align the inner shelters 42 with the second group transfer stations 32B, and steps 3F-3I can be repeated to cross the second strands 21B over the first group of strands 21A. These method steps can be repeated as desired until the braiding method is completed.

It should thus be appreciated that the braiding device 20 includes a pair of biasing members (e.g., springs 97 and 102) configured to iteratively move a first group of strands 21A to be braided from a first position that is circumferentially aligned with a second group of strands 21B to be braided, to a second position circumferentially offset with respect to the second group of strands, and subsequently return the first group of strands 21 to the first position. Furthermore, the pair of biasing members is configured to iteratively move the second group of strands 21B from the first position to the second position circumferentially offset with respect to the first group of strands 21A, and subsequently return the second group of strands 21B to the first position.

Referring now to FIGS. 1A-B and 4, the core holder 110 and core 112 are movably mounted onto the motor 30. In particular, the motor 30 can provide a linear actuator that, translates the core 112 vertically upward along the direction of Arrow V during the braiding method described above. Thus, when the braiding method begins, the core 112 is in a vertically depressed position, and the strands 21 are attached to the upper end of the core. As the core 112 translates vertically upward during operation, the strands 21 are braided successively down the length of the core 112 to define a braided structure 122. It should be appreciated that the vertical distance that separates successive turns of each strand 21 of the braided structure 122 in combination with the form diameter defines a braid pitch P. The braid pitch P increases as the speed of vertical translation of the core 112 increases during the braiding operation. The braid pitch P decreases as the speed of vertical translation of the core 112 decreases during the braiding operation.

It should be appreciated that the angle between the strands 21 and the core 112 tends to gradually increase during the braiding operation without adjusted translation of the core. As a result, the pitch P tends to gradually decrease along the braided structure. Accordingly, the braiding device 20 can include a linear actuator that adjusts the height of the core holder according to time during the braiding operation such that the braided structure can have an equal or substantially equal pitch along the braided structure 122.

Figure 1C:
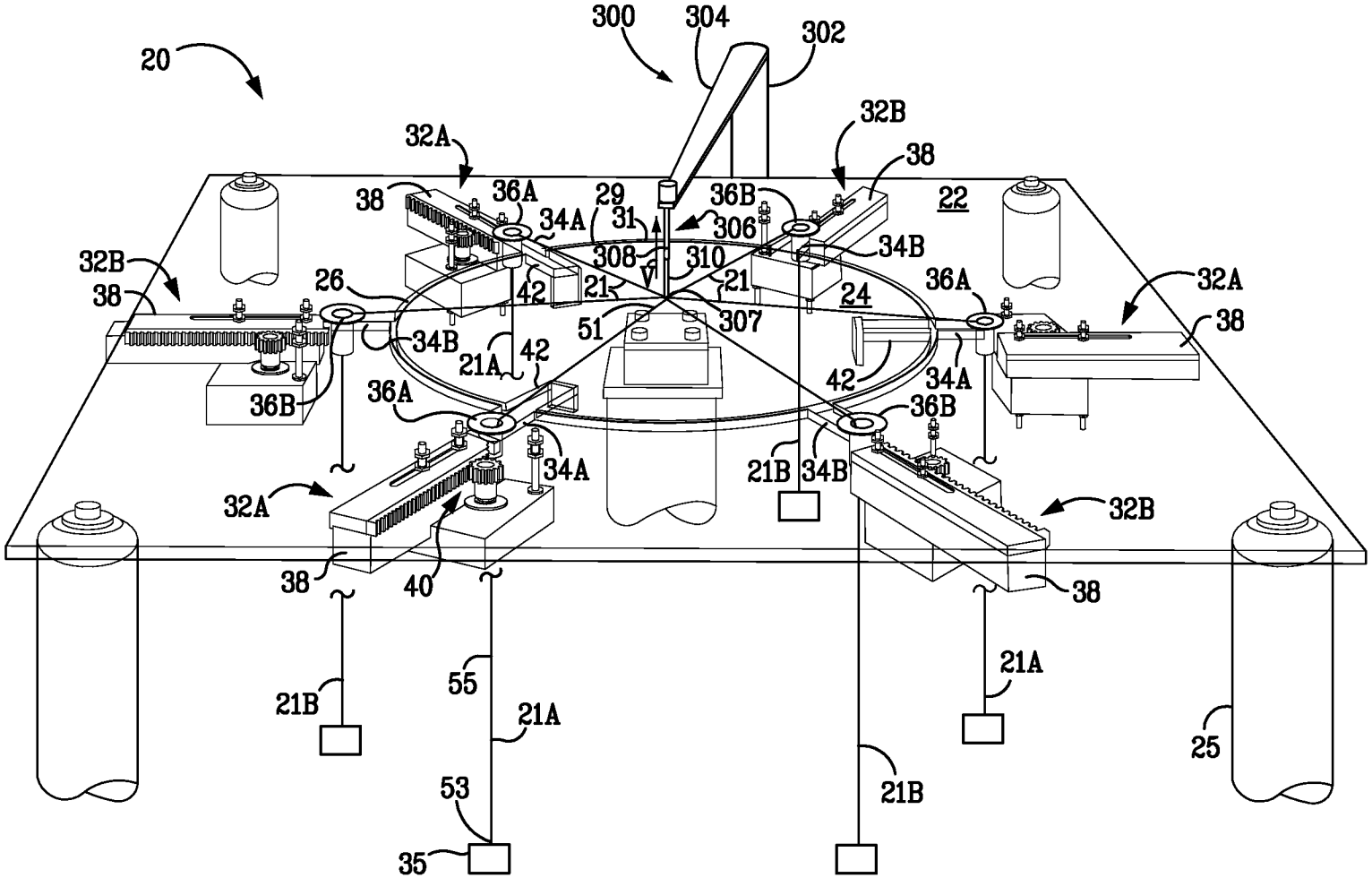
FIG. 1C is a perspective view of a braiding device similar to the braiding device illustrated in FIGS. 1A-B, but devoid of a core.

In the illustrated embodiment, the core holder 110 receive the core 112 such that the core 112 extends vertically up from the core holder if, for instance, the strands 21 are to be braided about a core. Alternatively, as illustrated in FIG. 1C, the strands 21 can be braided with no core. In particular, the braiding device 20 is constructed similar to FIGS. 1A-B, however the proximal ends 51 of the strands 21 are fixed to a cantilevered support 300. The support 300 includes a leg 302 that can extend up from a fixed location, such as the outer carrier member 22. The leg 302 is connected at its upper end to a boom 304 that extends radially to a location above the inner carrier member 24, and terminates at a location coincident with the axis of rotation of the inner carrier member 24. An attachment rod 306 extends down from the distal end of the boom 304 toward the inner carrier member 24, and defines a distal and 307 that provides an attachment location that is suspended above the inner carrier member to which the proximal ends 51 of the strands 21 are attached. The rod 36 can include an outer rod portion 308 extending down from the boom 304, and a telescoping inner rod portion 310 nested in the outer rod portion 308 and extending down from the outer rod portion 308. A motor (not shown) can cause the inner rod portion 310 to move vertically upward along the direction of Arrow V relative to the outer rod portion 308, and also relative to the carrier members 22 and 24. Accordingly, as the inner rod portion 310, and thus the attachment location 307 is translated upward during operation of the braiding device 20 in the manner described above, the strands 21 are braided below the inner rod portion 310 without a core.

While the braiding device 20 is described with reference to a capability of providing a symmetrical braid structure with six strands 21, it should be appreciated that the principles of the illustrated embodiment are applicable to braiding any number of strands as desired. By way of example, the device 20 includes six outer shelters 34 corresponding to six strands to be braided, and three inner shelters 42 corresponding to the size of the two groups of strands. However, if it is desired to braid a greater or lesser number of strands 21, carrier member 104 can be provided with a number of shelters corresponding to the number of strands to be braided, and the inner carrier member 104 can be provided with half the shelters as the outer carrier member 102.

Figure 5:
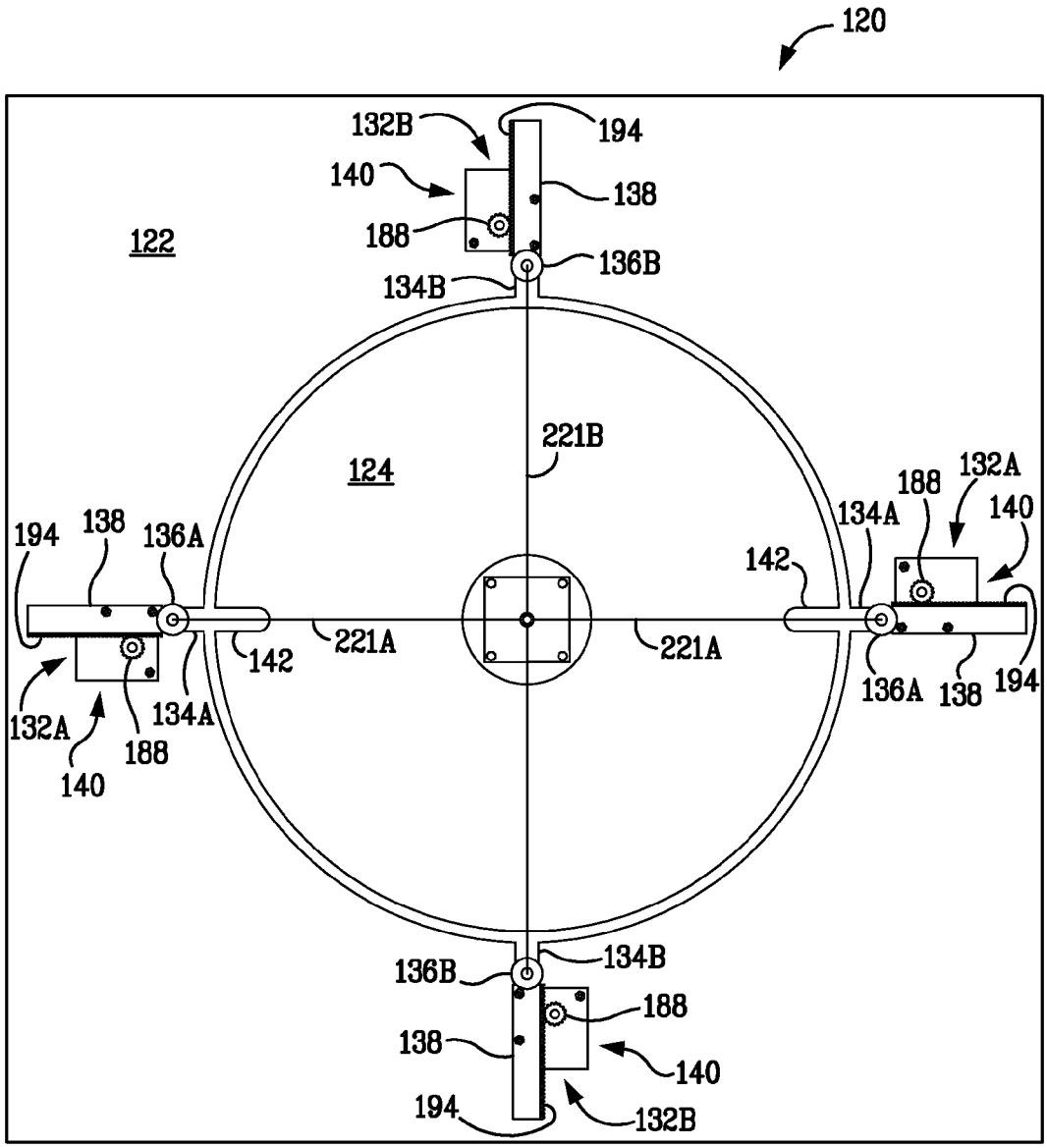
FIG. 5 is a top plan view of a braiding device constructed in accordance with an alternative embodiment.

For instance, FIG. 5 illustrates a braiding device 120 constructed in accordance with an alternative embodiment, whereby reference numerals corresponding to like structure of the braiding device are incremented by 100. The braiding device 120 is identically constructed as described above with respect to the braiding device 20, however the device 120 is configured to braid four strands 221 about the core 212 as a tetrode, and thus includes four outer shelters 134 and two inner shelters 142. Accordingly, the braiding device 120 is configured to provide a four-strand braided structure, also referred to as a tetrode.

Embodiments also contemplate that multiple braided structures 122 can be provided in sequence on the same core 112. For instance, a plurality of tetrodes can be created by the braiding device 120, and each tetrode can be braided into a multi-tetrode structure. In one embodiment, four tetrodes can be created using the device 120, and each tetrode can be braided into a four-tetrode braided structure.

Figure 6:
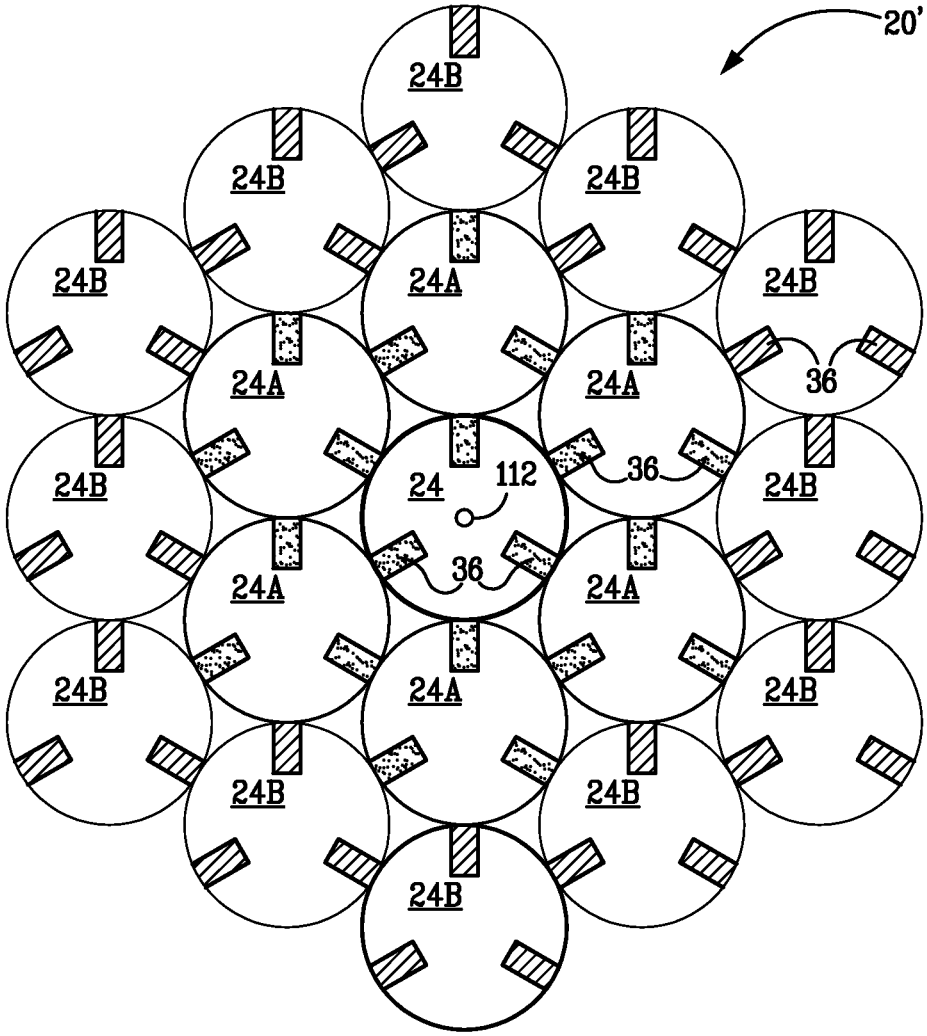
FIG. 6 is a top plan view of a braiding device constructed in accordance with another alternative embodiment.

Referring to FIG. 6, it should be appreciated that a microbraiding device 20' constructed in accordance with another embodiment can be expandable. The device 20' constructed in accordance with the structure and methods described above includes the inner carrier member 24, and the outer carrier member 22 is replaced with a ring of discrete individually rotatable outer carrier members 24A tangential to each other and to the inner carrier member 24. The carrier members 24 and 24A can have any number of transfer stations and shuttles as desired. The device 20' can further comprise second outer ring of outer carrier members 24B, in addition to any number of additional outer rings of carrier members as desired. Thus, it should be appreciated that the device 20' is expandable to include as many strands to be braided as desired. As illustrated, each carrier member 24, 24A, and 24B includes three shuttles 36 that iterate between six equidistantly spaced transfer stations and shelters in the manner described above. Accordingly, the shuttles can deliver the corresponding strands between adjacent carrier members 24, 24A, and 24B, and can further deliver the strands between adjacent outer carrier members of a given ring. The device 20' can operate in any desired sequence to create a braided structure as the carrier member 24 and rings of carrier members 24A and 24B rotate relative to each other as the shuttle 36 are transferred between carrier members.

While embodiments have been shown in the figures, it is to be understood that other similar embodiments may be used or modifications and additions may be made to the described embodiment without deviating from the spirit and scope of the subject matter recited in the appended claims. Therefore, the following claims should not be deemed limited to the illustrated embodiment, but rather should be construed in breadth and scope to encompass all such variations and modifications to the disclosed embodiment

The invention claimed is:

1. A braiding device suitable for making microbraids, the device comprising:

a first carrier including at least a first shelter;

a second carrier disposed proximate to the first carrier, such at least one of the carriers is movable with respect to the other carrier, the second carrier including at least a second shelter;

at least one shuttle configured to retain one of a plurality of strands, and a mover configured to move the shuttle between the first and second shelters, wherein the mover includes a first biasing member configured to impart a first biasing force onto the shuttle that biases the shuttle against the mover, and one of the first and second carriers includes a second biasing member configured to impart a second retention force that biases the shuttle into the corresponding shelter.

2. The braiding device as recited in claim 1, wherein the second carrier includes the second biasing member, and the mover is supported by the first carrier.

3. The braiding device as recited in claim 1, wherein the first shelter comprises a groove extending into the first carrier, and the second shelter comprises a groove extending into the second carrier.

4. The braiding device as recited in claim 3, wherein the at least one shuttle comprises a body configured for insertion into the grooves, and the body defines an aperture extending therethrough sized to receive the one of the plurality of strands.

5. The braiding device as recited in claim 4, further comprising an attachment location disposed centrally with respect to the second carrier and supporting each of the plurality of strands, wherein each strand defines a proximal end is attached to the core, a middle portion extending through the aperture of the body of the shuttle, and a distal end attached to a weight that induces tension in the middle portion.

6. The braiding device as recited in claim 5, further comprising a core that defines the attachment location.

7. The braiding device as recited in claim 5, wherein the attachment location is suspended above the second carrier member, such that the plurality of strands provided a braided structure that is devoid of a core.

8. The braiding device as recited in claim 1, wherein the first biasing force biases the shuttle in a direction toward the first shelter, and the second biasing force biases the shuttle in a direction toward the second shelter.

9. The braiding device as recited in claim 8, wherein the first biasing force is greater than the second biasing force.

10. The braiding device as recited in claim 9, wherein the first and second biasing members are magnets.

11. The braiding device as recited in claim 1, wherein the first carrier defines an opening, and the second carrier is rotatable inside the opening.

12. The braiding device as recited in claim 11, further comprising a plurality of the first shelters spaced equidistantly about the opening, and a plurality of the second shelters spaced equidistantly about a perimeter of the second carrier.

13. The braiding device as recited in claim 12, further comprising twice as many first shelters than second shelters.

14. The braiding device as recited in claim 13, wherein the plurality of first shelters is equal in number to the strands.

15. The braiding device as recited in claim 1, wherein the at least one strand is fibrous.

16. The braiding device as recited in claim 1, wherein the at least one strand has a diameter between 0.1 um and about 600 mm.

17. A braiding device suitable for fabricating microbraids, the braiding device comprising:

a first carrier including a plurality of first shelters;

a second carrier surrounded by the first carrier, the second carrier including a plurality of second shelters, such that one of the carriers is movable with respect to the other carrier;

a plurality of shuttles associated with each of the first shelters, wherein each shuttle is configured to retain one of a plurality of spool-less strands of micro fiber to be braided; and a plurality of transfer assemblies, each transfer assembly operatively coupled to a corresponding shuttle of the plurality of shuttles, wherein the transfer assembly moves the corresponding shuttle between a first position and a second position and the first carrier moves relative to the carrier so as to form a braided structure from the plurality of spool-less strands of micro fibers.

18. The braiding device as recited in claim 17, wherein each of the first shelters comprises a first biasing member configured to apply a first retention force that biases the shuttle in a direction toward the first shelter; and each of the second shelters comprises a second biasing member configured to apply a second retention force onto the shuttle that biases the shuttle in a direction toward the second shelter, such that the first retention force is greater than the second retention force.

19. The braiding device as recited in claim 18, wherein the first biasing member is stronger than the second biasing member, such that the first retention force is greater than the second retention force.

20. The braiding device as recited in claim 18, wherein each of the second shelters further comprises a dampener that reduces the retention force of the second biasing member.

21. The braiding device as recited in claim 18, wherein one the transfer assemblies is configured to deliver the corresponding shuttle from the first shelter to an aligned second shelter and the second biasing member of the aligned second shelter retains the shuttle in the second shelter upon an occurrence of relative motion between the first and second carriers.

22. The braiding device as recited in claim 21, wherein the first biasing member is configured to deliver the corresponding shuttle from an aligned second shelter to the first shelter after the occurrence of relative motion between the first and second carriers.

23. The braiding device as recited in claim 18, wherein the transfer assembly further comprises a mover that carries the first biasing member, and the mover is movable between a first position corresponding to the first carrier and a second position corresponding to the second carrier.

24. The braiding device as recited in claim 20, wherein each of the plurality of strands includes a proximal end configured to attach to an attachment location centrally disposed with respect to the second carrier, a weighted distal end, and a middle portion disposed between the proximal and distal ends, the middle portion configured to extend through the shuttle.

* * * * *

UNITED STATES PATENT AND TRADEMARK OFFICE

CERTIFICATE OF CORRECTION

PATENT NO. : 8,534,176 B2
APPLICATION NO. : 13/129925
DATED : September 17, 2013
INVENTOR(S) : Giszter et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 204 days.

Signed and Sealed this
Fifteenth Day of September, 2015

Michelle K. Lee

Michelle K. Lee
*Director of the United States Patent and Trademark Office*